US007419140B2

(12) United States Patent
Perry

(10) Patent No.: US 7,419,140 B2
(45) Date of Patent: Sep. 2, 2008

(54) SECURITY FENCE MODULE

(75) Inventor: Haim Perry, Edgewater, NJ (US)

(73) Assignee: Safeguards Technology LLC, Hackensack, NJ (US)

( * ) Notice: Subject to any disclaimer, the term of this patent is extended or adjusted under 35 U.S.C. 154(b) by 0 days.

(21) Appl. No.: 11/130,980

(22) Filed: May 16, 2005

(65) Prior Publication Data

US 2006/0255326 A1 Nov. 16, 2006

(51) Int. Cl.
*B21F 25/00* (2006.01)
*E04H 17/04* (2006.01)

(52) U.S. Cl. ..... 256/2; 256/10; 256/12

(58) Field of Classification Search ..... 256/12, 256/17, 10, 211, 65.14, 2, 11, 65.01; 340/541, 340/668, 664

See application file for complete search history.

(56) References Cited

U.S. PATENT DOCUMENTS 3,082,739 A * 3/1963 Schloemer ..... 119/61.1
4,525,701 A * 6/1985 Leih ..... 340/541
4,571,578 A * 2/1986 Karas ..... 342/27
4,730,809 A * 3/1988 Stoler ..... 256/1
4,920,331 A * 4/1990 Ver Loren van Themaat et al. ..... 340/541
5,116,256 A * 5/1992 Allen ..... 119/458
5,268,672 A * 12/1993 Kerr ..... 340/565
5,556,080 A * 9/1996 Vise ..... 256/24
5,564,367 A * 10/1996 Boyanton ..... 119/474
6,457,438 B1 * 10/2002 Baker ..... 119/498
6,836,213 B1 * 12/2004 Perry ..... 340/564

* cited by examiner

*Primary Examiner*—Daniel P. Stodola
*Assistant Examiner*—Nahid Amiri
(74) *Attorney, Agent, or Firm*—Bakos & Kritzer

(57) ABSTRACT

A fence module is adapted for installation without required anchoring buy providing a base frame and a plurality of upright supporting posts extending from the base frame. At least three fence sections extend between the supporting posts. A first fence section at a first extreme end of the fence module, a second fence section at a second extreme end of the fence module, and a third fence section angularly positioned between the first and second fence sections. A pair of vibration sensing modules are used to detect intruders, one applied to the first fence section and a second applied to the third fence section, with the first fence section positioned on the secure end of the protected zone.

8 Claims, 6 Drawing Sheets

SECURITY FENCE MODULE

FIELD OF THE INVENTION

The present invention relates to perimeter security and more specifically to a security fence module in a delay-and-detect type system.

BACKGROUND

Physical barriers in the form of fences are used to surround various facilities ranging from private homes to government installations. One type of fence provides a physical barrier, or delay mechanism, which inhibits a potential intruder from gaining access to a protected zone. Such fences include chain link fences, and razor coil fences. Another type of fence provides both a physical barrier and an alarm, or detection, functionality. Such fences include pressure sensor taut wire fences and rigid fences in combination with vibration sensing modules. This latter type is generally referred to as part of a delay-and-detect type system since the fence provides both a delay and a detect function.

An inherent difficulty with delay-and-detect fences is the need to balance the quality of detection with adequate delay. An extreme example is a brick wall employed as a high quality delay mechanism with a vibration sensor fitted onto the wall. As may be appreciated, it would require substantial interference with the wall to trigger an alarm in such a system thus providing low detection quality. The opposite is also a problem, for example in a system which combines a flexible chain link fence with a vibrations sensor where sensitivity is increased but physical delay properties are reduced. Accordingly, present delay-and-detect systems employ reliable sensing element in a first system and then set the required delay quality by providing a physical barrier placed inward of the detection system. This allows for mounting additional fences, digging trenches, and placing other barriers which do not interfere with the detection functionality and increase delay quality. However, at times, geographic and aesthetic considerations do not allow for extending the width of the perimeter fence as far into the protected zone as is desirable for placing sufficient obstacles for a required delay. Other times, physical soil properties may inhibit the construction of separate supporting structures for a detect system and a delay system. For example, digging may be difficult by way of utility lines running under the fence perimeter. In those instances, it is very difficult to provide a delay element without compromising the sensing capability of the combined system. Accordingly, there is a need for a compact delay-and-detect system which can be deployed over restricted terrain while providing for reliable delay and detect functionality.

SUMMARY OF THE INVENTION

In accordance with the present invention, a fence section is provided. The fence section includes a rectangular shaped planer base frame having a front support beam, and a rear support beam, a first lateral support beam coupled perpendicular to the first and second support beams substantially at respective ends thereof. A second lateral support beam is coupled perpendicular to the first and second support beams substantially at respective ends thereof, at least one additional lateral support beam is coupled in perpendicular to said first and second support beams substantially at respective ends thereof at a position between the first and the second lateral support beams. A first vertical support extends perpendicular to the plane defined by the base frame. The first vertical support is coupled to the base frame substantially proximate to the first lateral support beam. A second vertical support extends perpendicular to the plane defined by the base frame and is coupled to the base frame such that the second vertical support is closer to the front support beam of the base frame than the first vertical support is to the front support beam of the base frame. A third vertical support extends perpendicular to the plane defined by the base frame and is coupled to the base frame substantially proximate to the additional lateral support beam. The third vertical support is coupled to the base frame such that the line between the first vertical support and the third vertical support is substantially perpendicular to at least the first lateral support beam. A fourth vertical support extends perpendicular to the plane defined by the base frame and is coupled to the base frame substantially proximate to the additional lateral support beam. The fourth vertical support is coupled to the base frame such that the line between the second vertical support and the fourth vertical support is substantially perpendicular to at least the first lateral support beam.

The fence section also includes a first planar fence section coupled between the first and the third vertical supports and extends from a first end of the first and the third vertical supports to a point proximate a second end of the vertical supports, whereby the first end of the first and the third vertical supports is coupled to the base frame. A second planar fence section is coupled between the second and fourth vertical supports and extends from a first end of the second and fourth vertical supports to a point proximate a second end of the vertical supports, whereby the first end of the second and fourth vertical supports is coupled to the base frame. A third fence section is coupled between the first end of the second and fourth vertical supports and also between a point along the first and third vertical supports a predefined distance from the first end of the first and third vertical supports, whereby the third fence section defines a plane that forms an acute angle with the plane defined by the base frame at the second and fourth vertical supports. A first sensing module is coupled to the first fence section to sense vibrations applied through the first fence section. Finally, a second sensing module is coupled to the third fence section to sense vibrations applied through the third fence section.

Thus, there has been summarized and outlined, generally in broad form, a plurality of the most important features of the present invention, as described with respect to the foregoing preferred and alternate embodiments, in order that the following detailed description thereof which follows may be better understood by one of ordinary skill in the art. This summary and outline is further presented so that the novelty of the present contribution to the related art may be better appreciated. It will further be apparent that additional features of the invention described hereinafter and which will form the subject matter of the claims appended hereto will further define the scope, novelty, and in certain instances the improvements upon any existing art.

Further, it is to be readily understood that the invention presented herein is not limited in its application to the details of construction and to the arrangements of the components set forth in the following description or illustrated in the various figures integrated and categorized herein. The scope of the disclosure is presented in broad form so that other objects, features, and characteristics of the present invention, as well as the methods of operation and functions of the related elements of the structure, and the combination of parts and economies of manufacture, will become more apparent upon consideration of the following detailed description.

Those skilled in the art will appreciate that the disclosure of the present invention may readily be utilized as a basis for the designing of other similar structures, methods and systems for carrying out the various purposes and objectives of the present invention. Thus, the claims as set forth shall allow for such equivalent constructions insofar as they do not depart from the spirit and scope of the present invention as described herein.

BRIEF DESCRIPTION OF THE DRAWINGS

Embodiments of the invention will now be described, by way of example only, and with reference to the accompanying drawings, in which.

DETAILED DESCRIPTION

Figure 1:
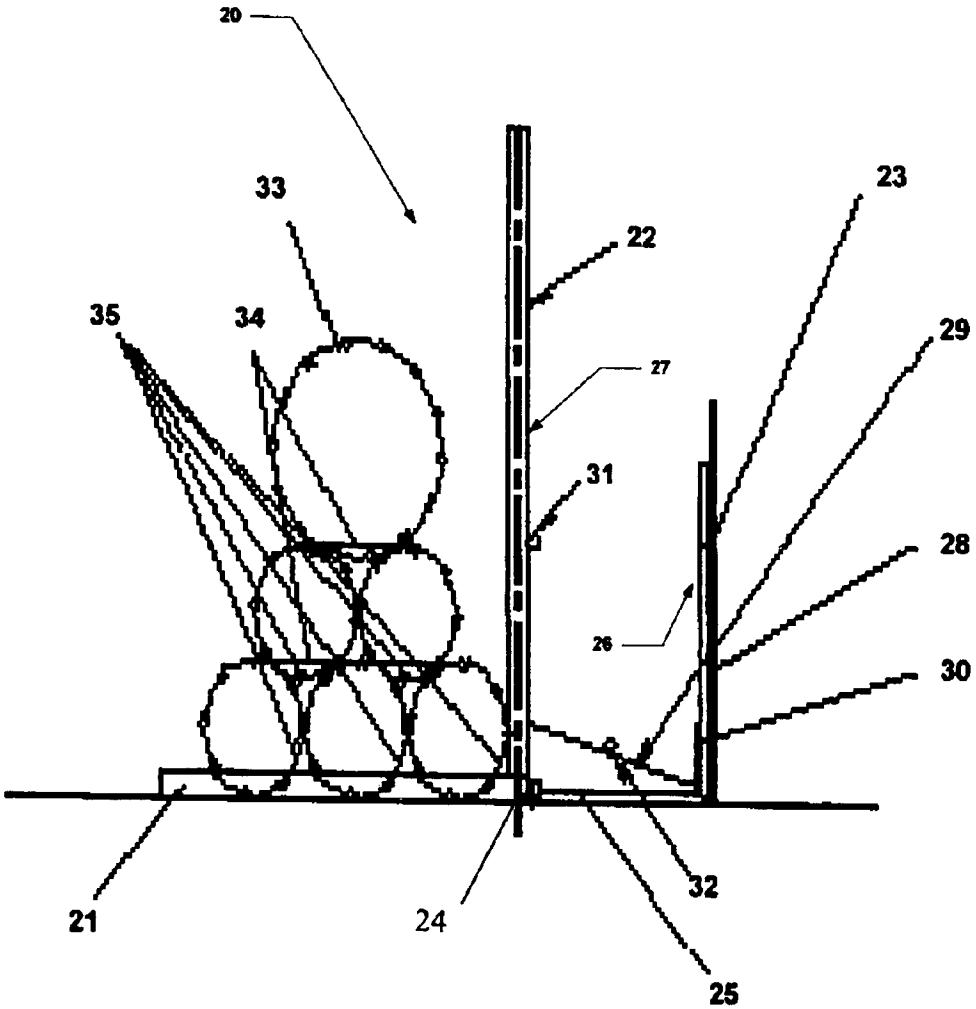
FIG. 1 illustrates a side view of a fence module of the invention.

A further understanding of the present invention and the objectives other than those set forth above can be obtained by reference to the various embodiments set forth in the illustrations of the accompanying figures. Although the illustrated embodiment is merely exemplary of systems for carrying out the present invention, both the organization and method of operation of the invention, in general, together with further objectives and advantages thereof, may be more easily understood by reference to the drawings and the following description. The figures are not intended to limit the scope of this invention, which is set forth with particularity in the claims as appended or as subsequently amended, but merely to clarify and exemplify the invention. The detailed description makes reference to the accompanying figures wherein:

FIG. 1 illustrates a fence section module 20 of a delay-and-detect system in accordance with the invention. The fence section structural support elements include a base frame 21, a first upright post 22, and an extension arm 23. The first upright post 22 is coupled to a first end 24 of the base frame 21 so as to extend substantially perpendicular to the plane defined by base frame. A first end of the extension arm 23 is coupled the same first end 24 of the base frame 21 so as to extend parallel to the base frame. The extension arm 23 includes a lower portion 25 that is parallel to the base frame and a second upright post 26 extending perpendicular from an end of the lower portion. Each frame section includes at least two sets of first upright posts 22 and extension arms 23. As may be appreciated, adjacent fence modules provide additional structural support elements.

A first semi-rigid fence section 27 is coupled between each adjacent pair of first upright posts 22. The first fence section 27 is preferably coupled to the first upright posts 22 so as to provide a generally flat vertical fence plane extending parallel to the vertical plane defined by the first upright posts 22. In one embodiment, the first fence section 27 extends in line with the upper edges of the first upright posts 22, as is illustrated in FIG. 1. In another embodiment, the first fence section 27 extends beyond the edge of the first upright posts 22.

Figure 5:
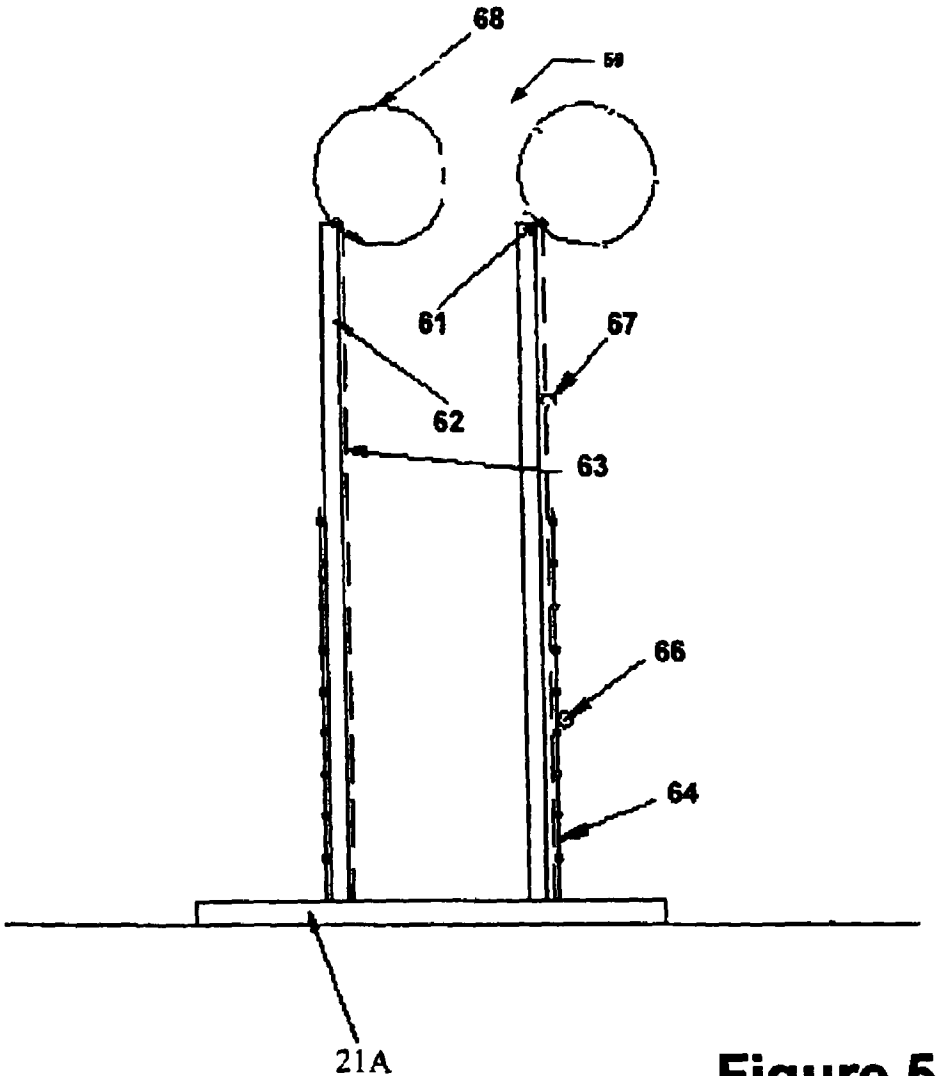
FIG. 5 illustrates a compact fence module in accordance with the invention.

A second semi-rigid fence section 28 is coupled between second upright posts 26 of adjacent extension arms 23. The second fence section 28 is preferably coupled to the second upright posts 26 so as to provide a generally flat vertical plane extending parallel to the vertical plane defined by the upright supports 26. In the embodiment illustrated in FIG. 1, the second fence section extends beyond the edge of the second upright posts 26. In other embodiments, the second fence section extends only to the edge of the second upright posts 26 (FIG. 5) . A third semi-rigid fence section 29 is coupled between the second upright posts 26 and a point located a short distance along the first upright post 22 from the connection point of the first upright post and the base frame 21. In one embodiment, the third fence section 29 is coupled so as to form an acute angle between the third fence section and the extension arm lower portion 25. In one embodiment, this angle is about 30 degrees. In the illustrated embodiment, an extension portion 30 of the third section 29 is positioned parallel to the second fence section and is supported by the second upright posts 26.

A first vibration sensing module 31 is coupled to the first fence section 27 so as to sense disturbances of the first fence section by a possible intruder. A second vibration sensing module 32 is coupled to the third fence section 29 so as to sense disturbances of the third fence section. As may be appreciated, the first vibration sensing module 31 and the second vibration sensing module 32 may each include a plurality of sensors equally spaced along the first fence section 24 and the third fence section 29 or a continuous sensing module such as a fiber optic cable.

Figure 2:
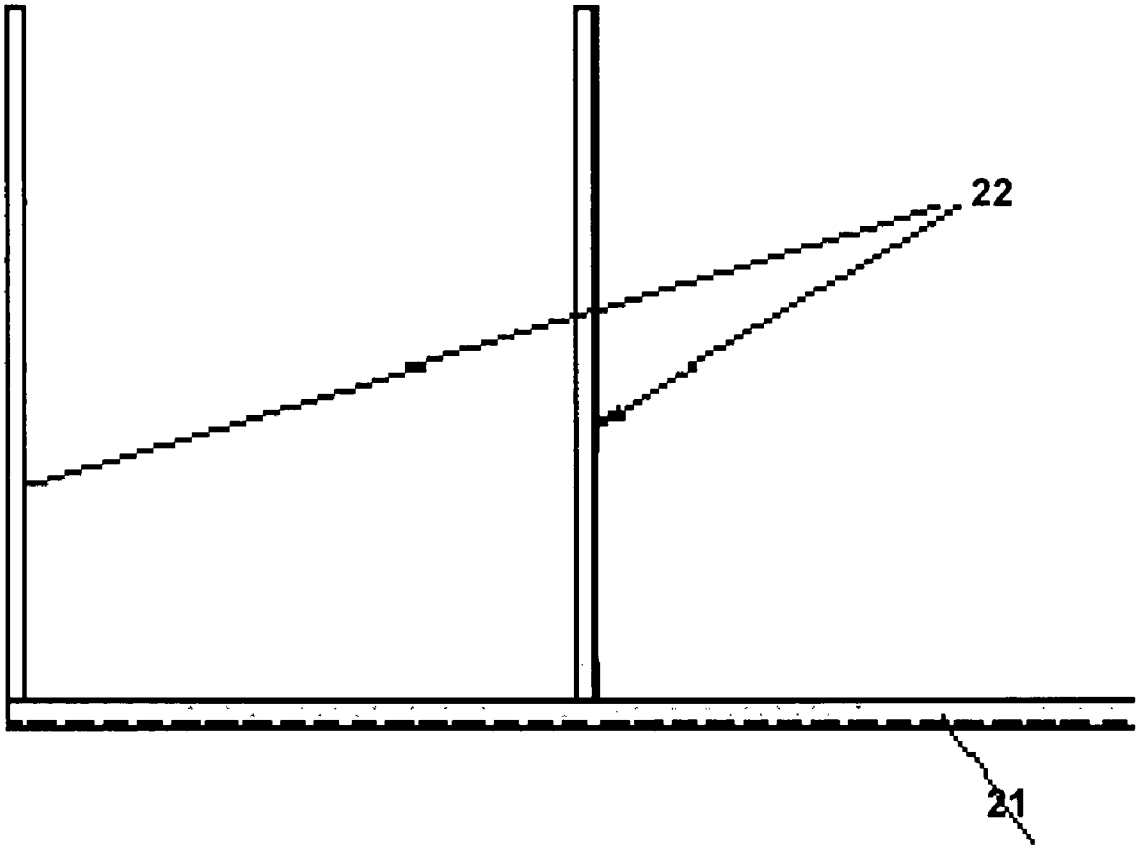
FIG. 2 illustrates a front view of a planar base frame and upright post of a fence section of FIG. 1.

FIG. 2 illustrates a front view of a planar base frame of fence module 20 of FIG. 1. A pair of first upright posts 22 are shown positioned in perpendicular to the base frame 21.

Figure 3:
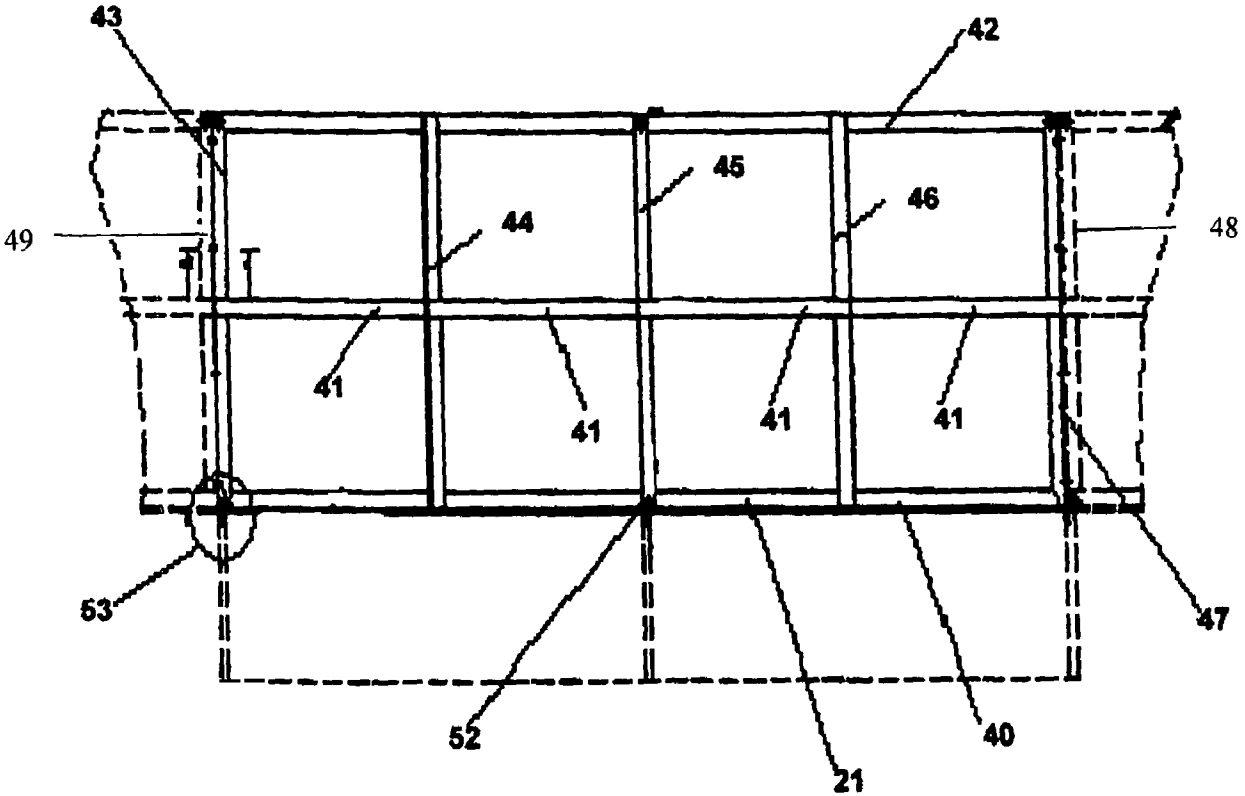
FIG. 3 illustrates a top view of a planar base frame of a fence section of FIG. 1.

FIG. 3 illustrates a top view of a planar base frame of the fence module of FIG. 1. In the illustrated embodiment, each base frame 21 includes three parallel longitudinal beams 40, 41, 42 and five parallel lateral beams 43, 44, 45, 46, 47. Two of the longitudinal beams serve as a front beam 40 and as a rear beam 42 of the base frame. Two of the lateral beams serve as end beams 43, 47. As discussed with reference to FIGS. 1 and 2, the first upright posts 22 and the extension arms 23 are coupled to the front beam 40 of the base frame. In one embodiment, these connection points proximate to the connection points 52, 53 coupling the end lateral beam 43 and the central lateral beam 45 to the front beam 40. In the illustrated embodiment, no support section elements are coupled to one of the two end beams 47.

To provide a continuous perimeter fence, adjacent base frames are initially joined by connecting an end beam 47 which does not include supporting structure to an end beam 43 on an adjacent module which includes supporting structure. As may be appreciated, in some embodiments, the base from is coupled to other base frames before any supporting structure is installed.

In some embodiments, the base frame 21 is anchored to the underlying substrate by anchor elements (not shown) positioned adjacent to beams of the base frame. Accordingly, the optional anchoring elements are placed at various locations within the interior of the frame defined by the end beams 43, 47, and the front and rear beams 40, 42, as permitted by terrain conditions. This anchoring is much more flexible than prior methods which required linear anchoring, at points along the length of a fence section where supporting posts are to be situated.

As illustrated in FIG. 1, in one embodiment, a razor coil configuration 33 is placed on the base frame 21 of the fence module, adjacent to the upright support post 22, to provide an additional delay mechanism. In the illustrated razor coil configuration, a pair of braces 34 are used to secure razor coil elements 35 to one another so as to provide for a rigid pyramid-like coil structure 33.

As may be appreciated, a plurality of fence modules are coupled together as discussed above to form a barrier extending from a first fence module to a final module at an opposite end of the barrier. The barrier modules are positioned such that the extension arms 23 are facing the exterior, or non-secure, side of the barrier.

Referring again to FIG. 3, in operation, the second fence section 28, coupled to the second upright posts 26, serves as a delay mechanism to inhibit access to the sensor modules 31, 32, and prevent objects from striking the third fence section or the first fence section and thereby trigger a false alarm. If an intruder gains access through the second fence section 28, contact will be made with the third fence section 29, which is positioned at an angle extending from the base of the second fence section. The second vibration sensing module 32 senses such contact and reports an alarm condition. An attempt to bypass the detection provided by the third fence section 29 and directly jump onto or climb the first fence section 27 will be detected by the first vibration sensing module 31 coupled to the first fence section. The first fence section 27 also serves to delay an intruder so as to allow time for security personnel to arrive at the alarm location when an alarm is triggered by contact with the third fence section or the first fence section 27. Additional delay is provided by the razor coil configuration 33 placed beyond the first fence section 27 in the illustrated embodiment.

As may be appreciated, the use of the angular third fence section 29 provides for an early alarm indication, prior to the time an intruder attempts to bypass the first fence section 27. Furthermore, the rate of false alarms resulting from animal contact with the third fence section 29 is reduced by placing the third fence section behind the second fence section 28. Moreover, the second fence section 28 prevents tampering with the sensors 31, 32 on the first fence section 27 and the third fence section 29. The fence section configuration of the invention provides early detection of potential intrusion at substantially lower costs than those associated with prior art configurations where independent sensing systems are placed in front of a physical barrier, such as by placing a microwave system in front of a razor wire fence. The third fence section configuration is also substantially cheaper than pressure or vibration sensing means buried in the ground in front of the physical barrier. Moreover, such buried sensing systems may not be suitable where conditions do not allow for digging. Additionally, the third fence section configuration provides a compact physical barrier that can be placed in space restricted environment.

Figure 4:
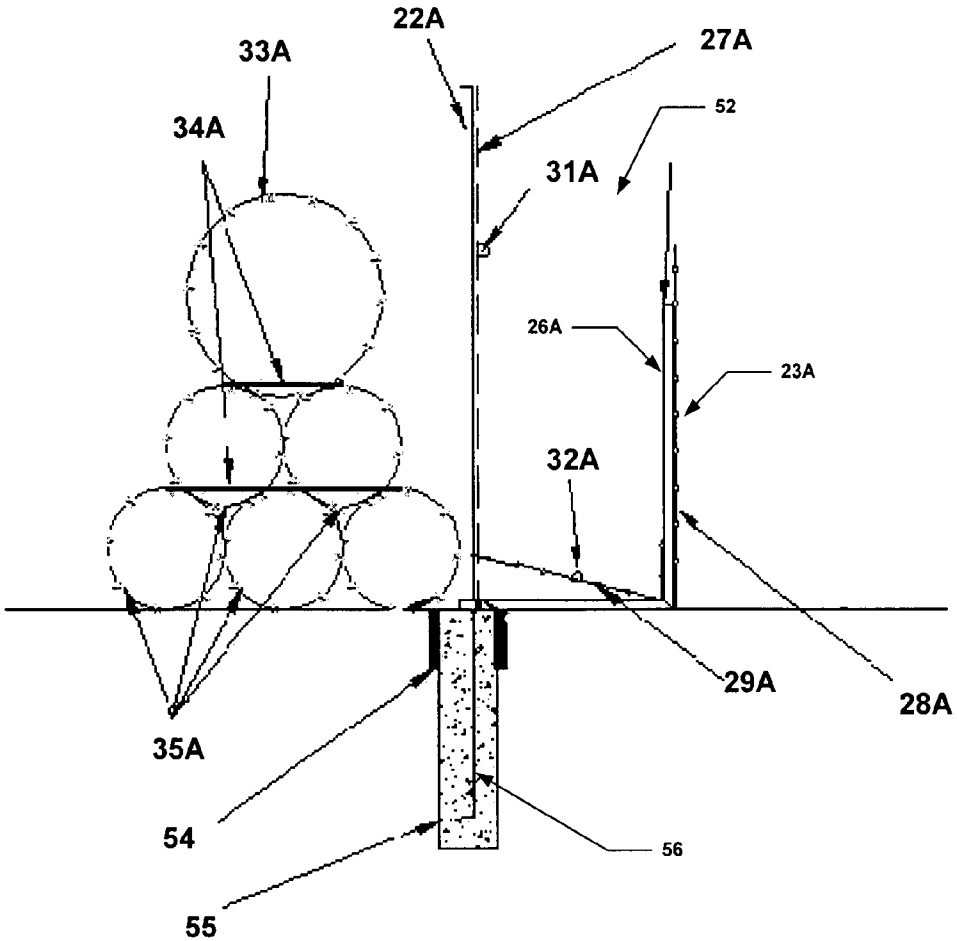
FIG. 4 illustrates an alternate, anchored embodiment, of the fence module of FIG. 1.

FIG. 4 illustrates an embodiment of a fence module in accordance with the invention, where the base frame is replaced by a ground anchor, provided below the first upright posts 22A. Where conditions allow anchoring, a fence module of the invention, as illustrated in FIG. 4, nonetheless provides advantages over prior systems by the high delay and detection capabilities relative to the overall dimensions of the module. An anchoring extension 56 is provided from the first upright post 22A so as to extend below the supporting surface, preferably in a underground cavity. The first upright support post 22A is preferably anchored within a rigid anchoring substance 55 such as concrete. An optional supporting sleeve 54 is provided around the substrate cavity. As may be appreciated, various anchoring techniques may be used in other embodiments without departing from the spirit of the invention.

FIG. 5 illustrates an alternate configuration of a fence module of the invention, which is configured for use in restricted spaces. The fence module 59 is intended for use in areas where topographical or environmental conditions do not allow for placement of configurations such as those in FIG. 1. The fence module 59 maintains the overall configuration of the invention by employing a pair of supporting posts 61, 62, and a base frame 21A. The base frame 21A is constructed substantially as discussed with reference to the base frame of FIG. 3, with differences including different connection points to the supporting posts as may be appreciated. Sensor modules 66, 67, are provided on a first fence section 64 of the first supporting post 61. A second fence section 63 is also provided on the second supporting post 62 for additional delay functionality. A pair of razor coils 68 are provided above the first and second supporting posts 61, 62 so as to provide additional delay when an intruder attempts to climb over the fence module 59. An advantage of the fence module 59 is that it does not require anchoring and can be installed and removed without disturbing the underlying substrate. Accordingly, the fence module 59, as well as the fence module of FIG. 1 are suitable for installing over access roads, above sewage pipes and other utilities, and over rocky terrain.

Figure 6:
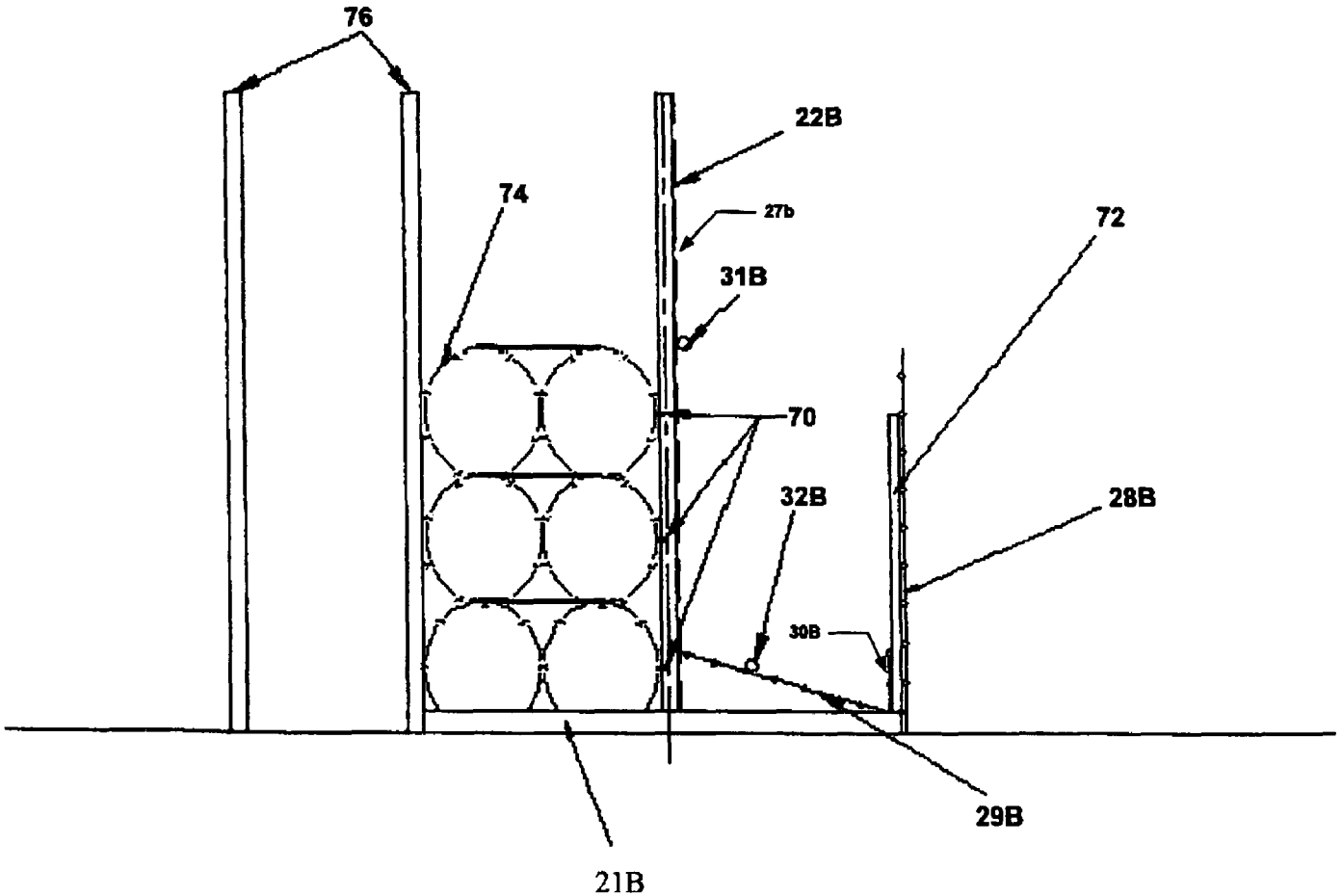
FIG. 6 illustrates an alternate embodiment of a compact fence module in accordance with the invention.

FIG. 6 illustrates a fence module 70 in accordance with the invention, which is configured for placement adjacent to an existing fence or other structure. The fence module includes a first supporting post 22B, a base frame 21B, and a second supporting post 72. The first support post 22B and the second supporting post 72 are coupled to the base frame 21B so as to extend perpendicular from the base frame. A first fence section 27B is coupled between adjacent first supporting posts. A second fence section 28B is coupled between adjacent second supporting posts 72. A third fence section 29B is coupled between the second supporting posts 72, and the first supporting posts 22B. The third fence section 29B is coupled between the second supporting posts 72 and the first supporting posts 22B so as to form an acute angle with the base frame 21B as is shown in FIG. 6. A first sensor module 31B is coupled to the first fence section 27B. A second sensor module 32B is coupled to the third fence section 29B. A plurality of razor coils 74 is provided on the base frame behind the first fence section so as to occupy a space between the first fence section and an existing fence 76. Accordingly, the fence module of FIG. 6 provides delay and detection capabilities in a restricted space environment, without interference with the underlying substrate and in a configuration which maximizes delay while providing reliable sensing functionality (i.e., low false alarms, high detection reliability).

Although the present invention was discussed in terms of certain preferred embodiments, the invention is not limited to such embodiments. A person of ordinary skill in the art will appreciate that numerous variations and combinations of the features set forth above can be utilized without departing from the present invention as set forth in the claims. Thus, the scope of the invention should not be limited by the preceding description but should be ascertained by reference to claims that follow.

The invention claimed is:

1. A security fence section in a fence formed along a boundary, the boundary having a secured side and an unsecured side, comprising:

a rectangular base positioned on an underlying surface forming part of the boundary, the base including a first end beam, a second end beam, a first lateral support and a second lateral support, each coupled perpendicular to the first and second end beams, the first end beam positioned closer to said unsecured side of said boundary than said second end beam;

a first rectangular fence section extending perpendicular to the base and between a second rectangular fence section extending perpendicular to the base and between the first and second lateral supports substantially near the second end beam, said second fence section including at least two support posts and a section of semi-rigid fencing extending therebetween, said semi-rigid fencing providing a continuous barrier extending from lower portions to upper portions of said at least two support posts;

a third rectangular fence section extending from the base near the first end beam to a predetermined point along each of the support posts of the second rectangular fence section to form an acute angle greater than zero degrees between the third section and the rectangular base, said third fence section including at least two support posts coupled between said base and said point along each of said support posts of said second fence section and further including a section of semi-rigid fencing extending therebetween, said semi-rigid fencing providing a continuous barrier extending from the base to said point along each of the support posts of the second fence section;

a first sensing module coupled to the second fence section to sense vibrations applied to said second fence section so as to detect intrusion of said boundary from said unsecured side; and a second sensing module coupled to the third fence section to sense vibrations applied to said third fence section so as to detect intrusion of said boundary from said unsecured side.

2. The fence section of claim 1, further including a razor coil configuration provided on top of the base between the second fence section and the second end beam.

3. The fence section of claim 1, wherein said acute angle is about 30 degrees.

4. The fence section of claim 1, wherein the base is loosely coupled to the underlying surface.

5. The fence section of claim 1, further comprising anchor elements in the base frame to allow for rigidly coupling the base to an underlying surface.

6. A security fence section for detecting intrusion into a boundary having a secure side and a non-secure side, comprising:

a rectangular base having a first end facing the non-secure side of the boundary and a second end facing the secure side of a boundary, the base positioned flat on an underlying surface of said boundary along said boundary;

a first vertical fence section including semi-rigid fence barrier element extending perpendicular from the first end of the base;

a second fence section extending perpendicular from the second end of the base;

a third fence section extending at an angle from the first end of the base to intersect the second fence section at a predetermined distance from the second end of the base to provide a rising slope from the first end to the second end of the base; and a vibration sensing module positioned on the second fence section and the third fence sections to detect intrusion of said boundary by disruption of either said second fence section or of said third fence section.

7. The fence section of claim 6, wherein the base is loosely coupled to the underlying surface.

8. The fence section of claim 6, further comprising anchor elements in the base to allow for rigidly coupling the base to an underlying surface.

* * * * *